US010939223B2

(12) United States Patent
Heil

(10) Patent No.: US 10,939,223 B2
(45) Date of Patent: Mar. 2, 2021

(54) APPARATUS FOR REPRODUCING A MULTI-CHANNEL AUDIO SIGNAL AND A METHOD FOR PRODUCING A MULTI CHANNEL AUDIO SIGNAL

(71) Applicant: L-ACOUSTICS UK LTD, London (GB)

(72) Inventor: Christian Heil, London (GB)

(73) Assignee: L-ACOUSTICS UK LTD, London (GB)

( * ) Notice: Subject to any disclaimer, the term of this patent is extended or adjusted under 35 U.S.C. 154(b) by 0 days.

(21) Appl. No.: 15/570,608

(22) PCT Filed: Apr. 28, 2016

(86) PCT No.: PCT/EP2016/059561

§ 371 (c)(1),
(2) Date: Oct. 30, 2017

(87) PCT Pub. No.: WO2016/174174

PCT Pub. Date: Nov. 3, 2016

(65) Prior Publication Data

US 2018/0288555 A1 Oct. 4, 2018

(30) Foreign Application Priority Data

Apr. 28, 2015 (EP) ..... 15165526

(51) Int. Cl.
*H04R 7/00* (2006.01)
*H04S 3/00* (2006.01)
(Continued)

(52) U.S. Cl.
CPC ..... *H04S 7/303* (2013.01); *H04R 5/02* (2013.01); *H04R 27/00* (2013.01); *H04S 3/002* (2013.01);
(Continued)

(58) Field of Classification Search
CPC ..... H04S 7/303; H04S 3/002; H04S 2400/11; H04S 2400/13; H04S 7/30; H04R 5/02; H04R 27/00; H04R 2430/01
See application file for complete search history.

(56) References Cited

U.S. PATENT DOCUMENTS 5,610,986 A 3/1997 Miles
6,498,857 B1 * 12/2002 Sibbald ..... H04S 7/30 381/1
(Continued)

FOREIGN PATENT DOCUMENTS

EP 0966179 A2 12/1999
JP 1998014000 A 1/1998
(Continued)

OTHER PUBLICATIONS

Buitendjiuk, "A 40 W Integrated Car Radio Audio Amplifier", IEEE, 1991 (Year: 1991).*
(Continued)

*Primary Examiner* — Sonia L Gay
(74) *Attorney, Agent, or Firm* — Cantor Colburn LLP

(57) ABSTRACT

A method for producing a multi-channel audio signal from one or more sound object signals is disclosed, where, for each sound object signal a plurality of width signals is produced, the amplitudes of the width signals following a substantially Gaussian distribution. The width signals are processed to produce a plurality of pan signals which are mapped to at least one channel. Each channel in the audio signal is produced by combining the pan signals from each sound object. An apparatus for reproducing such a multi-channel audio signal is also disclosed, in which a plurality of first loudspeakers are provided spaced around a first arc forward of a predetermined listening zone, each of the first loudspeakers facing towards the listening zone and substantially equidistant therefrom. A plurality of second loud-
(Continued)

speakers are provided spaced around a second arc behind the listening zone, each of the second loudspeakers facing towards the listening zone. An amplifier produces an amplified signal from each channel in the audio signal, each amplified signal being provided to a corresponding first or second loudspeaker whereby in use each sound object is reproduced by one or more loudspeakers such that the SPL at a point spaced from the apparatus is less than the SPL at the listening zone.

7 Claims, 7 Drawing Sheets

(51) Int. Cl.
*H04R 5/02* (2006.01)
*H04R 27/00* (2006.01)
*H04S 7/00* (2006.01)

(52) U.S. Cl.
CPC ..... *H04S 3/008* (2013.01); *H04R 2430/01* (2013.01); *H04S 7/30* (2013.01); *H04S 2400/11* (2013.01); *H04S 2400/13* (2013.01)

(56) References Cited

U.S. PATENT DOCUMENTS 7,310,604 B1* 12/2007 Cascone ..... G10K 15/02 704/272
2006/0045283 A1* 3/2006 Lin ..... G10K 15/12 381/63
2014/0270184 A1* 9/2014 Beaton ..... H04S 7/307 381/17
2015/0043736 A1 2/2015 Olsen et al.
2016/0157016 A1* 6/2016 Chamness ..... H04R 3/04
2018/0115850 A1* 4/2018 De Burgh ..... H04S 7/30

FOREIGN PATENT DOCUMENTS

JP 2001134272 A 5/2001
JP 2012525051 A 10/2012
WO 2005086527 A1 9/2005

OTHER PUBLICATIONS

Franz Zotter et al. "Phantom Source Widening with Deterministic Frequency Dependent Time Delays", Proc. of the 14th Int. Conference on Digital Audio Effects, Sep. 19-23, 2011, pp. 307-312.
International Search Report dated Jun. 3, 2016 re: Application No. PCT/EP2016/059561; pp. 1-6; citing: Chang et al. "Experimental validation . . . ", WO 2005/086527 A1, EP 0 966 179 A2, US 2015/043736 A1, V. Pulkki "Uniform spreading . . . " and Zotter et al. "Phantom Source . . . ."
Ji-Ho Chang et al. "Experimental validation of sound field control with a circular double-layer array of loudspeakers", The Journal of Acoustical Society of America, Apr. 1, 2013, vol. 133, No. 4, pp. 2046-2054.
Ville Pulkki "Uniform spreading of amplitude panned virtual sources", Proceedings of the 1999 IEEE Workshop on Applications of Signal Processing to Audio and Acoustics, WASPAA, Oct. 17-20, 1999, pp. 187-190.
Written Opinion dated Jun. 3, 2016 re: Application No. PCT/EP2016/059561; pp. 1-11; citing: Chang et al. "Experimental validation . . . ", WO 2005/086527 A1 and EP 0 966 179 A2.

* cited by examiner

APPARATUS FOR REPRODUCING A MULTI-CHANNEL AUDIO SIGNAL AND A METHOD FOR PRODUCING A MULTI CHANNEL AUDIO SIGNAL

FIELD OF THE INVENTION

The present invention relates to multi-channel audio systems.

BACKGROUND AND PRIOR ART

Multi-channel audio systems are distinguished from stereophonic audio systems by the number of channels of audio information and the corresponding number of loudspeakers used for playback. While stereophonic systems are characterised by two channels, common multi-channel audio systems have 5 or more channels.

One of the goals of multi-channel audio systems is to provide a listener with the immersive experience of a conductor or an artist on stage.

One factor important to such an experience is the ability produce a realistic "sound stage" in which each object—for example musical instruments—within the produced sound is perceived by the listener to be originating from a position. Sound engineers place each sound object, typically at a virtual position between two channels, when mixing a multi-channel audio signal. The component of each sound object in the two channels is then determined using amplitude panning. When each channel is reproduced by a corresponding loudspeaker, the sound is perceived by the listener to originate from a location determined by the amplitude panning and the location of the loudspeakers to the listener.

Another factor important to such an experience is the sound pressure level (SPL) the system is able to produce where the listener is positioned. Concerts and similar live performances can involve peak SPL above 120 dB.

Most multi-channel audio systems have loudspeakers placed near the walls of a room, with the listener positioned towards the centre of the room. To provide an SPL of 120 dB at the listener with such an arrangement, the SPL at most positions along the walls of the room itself is greater than 120 dB, which is undesirable in residential environments.

SUMMARY OF THE INVENTION

In accordance with a first aspect of the invention there is provided an apparatus for reproducing a multi-channel audio signal consisting of one or more sound objects in which each sound object is present in a plurality of channels, the apparatus comprising:

- A plurality of first loudspeakers provided spaced around a first arc forward of a predetermined listening zone, each of the first loudspeakers facing towards the listening zone and substantially equidistant therefrom;
- A plurality of second loudspeakers provided spaced around a second arc behind the listening zone, each of the second loudspeakers facing towards the listening zone;
- An amplifier arranged to produce an amplified signal from each channel in the audio signal, each amplified signal being provided to a corresponding first or second loudspeaker;
- Whereby in use each sound object is reproduced by one or more loudspeakers such that the SPL at a point spaced from the apparatus is less than the SPL at the listening zone.

Preferably, the SPL at a point spaced from the apparatus the same distance as each first loudspeaker is spaced from the listening zone is 15 dB less than the SPL at the listening zone.

Preferably, the number of first and second loudspeakers is at least 13, the number of first loudspeakers being greater than the number of second loudspeakers.

Preferably, the plurality of second loudspeakers are provided closer to the listening zone than the first loudspeakers.

Preferably, the apparatus further comprises an enclosure provided behind the listening zone, the amplifier and second loudspeakers being housed within the enclosure.

Preferably, the apparatus further comprises a subwoofer housed within the enclosure.

Preferably, each first loudspeaker is provided within a corresponding enclosure, the enclosures of adjacent first loudspeakers being coupled together.

Preferably, the multi-channel audio signal is produced by the method of any one of claims 5 to 8.

In accordance with a second aspect of the invention there is provided a method for producing a multi-channel audio signal from one or more sound object signals, comprising:

For each sound object signal:

- Producing a plurality of de-correlated width signals, wherein the amplitudes of said width signals follows a substantially Gaussian distribution;
- Processing the plurality of width signals to produce a plurality of pan signals, each pan signal being mapped to at least one channel;

For each channel in the audio signal, combining the pan signals from each sound object for that channel.

Preferably, the step of de-correlating the phase of each width signal comprises adding to each width signal a different phase offset, and altering the phase offset of each width signal with a period T.

Preferably, the substantially Gaussian distribution follows a user-configurable standard deviation.

Preferably, the user-configurable standard deviation is configurable for each sound object signal.

Preferably, the method further comprises the step of normalising the amplitudes of the width signals such that the amplitude of sum of the width signals is equal to the amplitude of the sound object signal.

Preferably, the method further comprises processing each sound object signal to produce a depth-corrected signal, and producing the plurality of width signals from the depth-corrected signal.

BRIEF DESCRIPTION OF THE FIGURES

The invention will now be described, by way of example, with reference to the accompanying drawings, in which.

DESCRIPTION OF PREFERRED EMBODIMENTS

Figure 1:
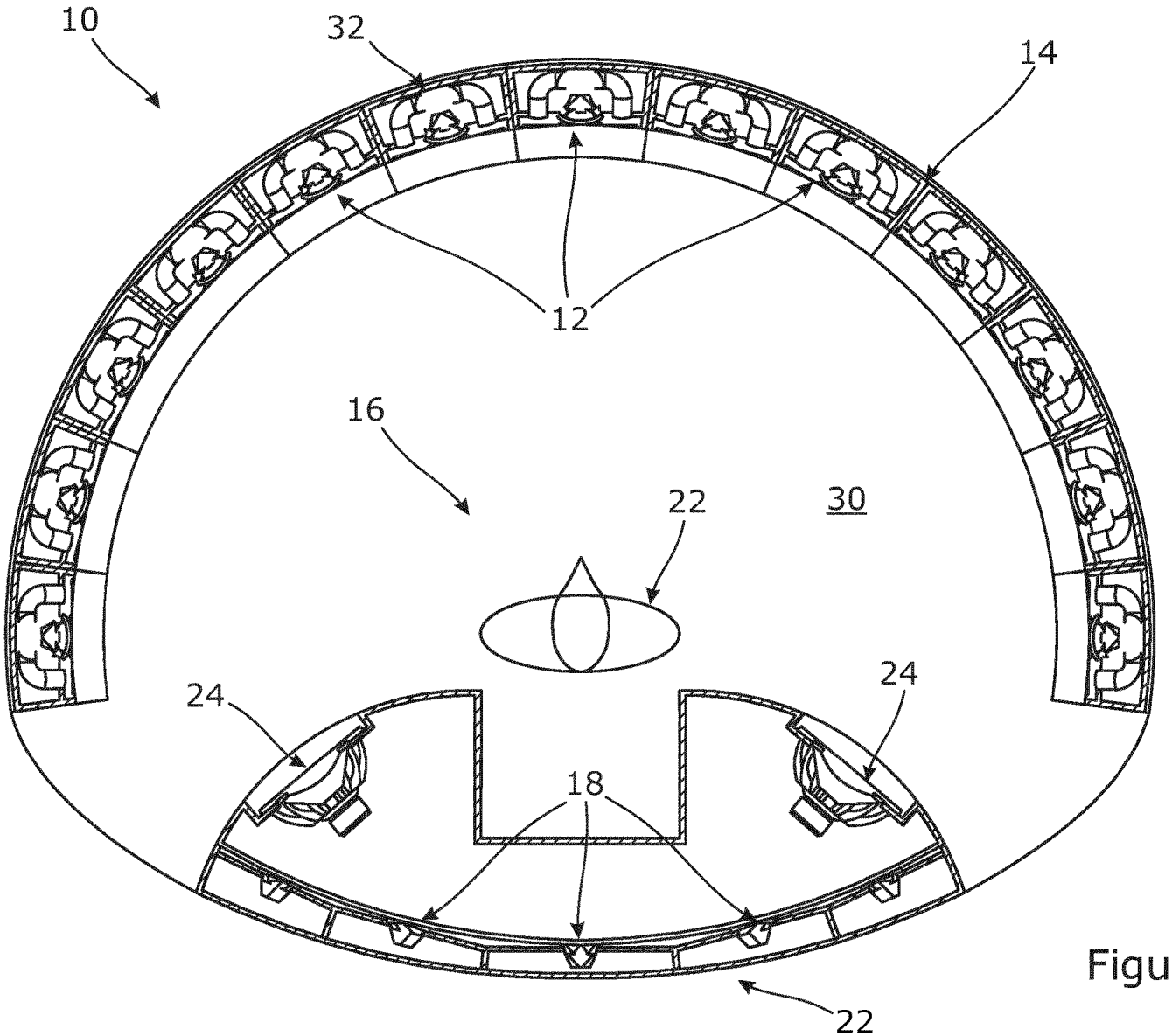
FIG. 1 is a top view, partially cut away, of an apparatus for reproducing a multi-channel audio signal according to one embodiment of the invention.
Figure 2:
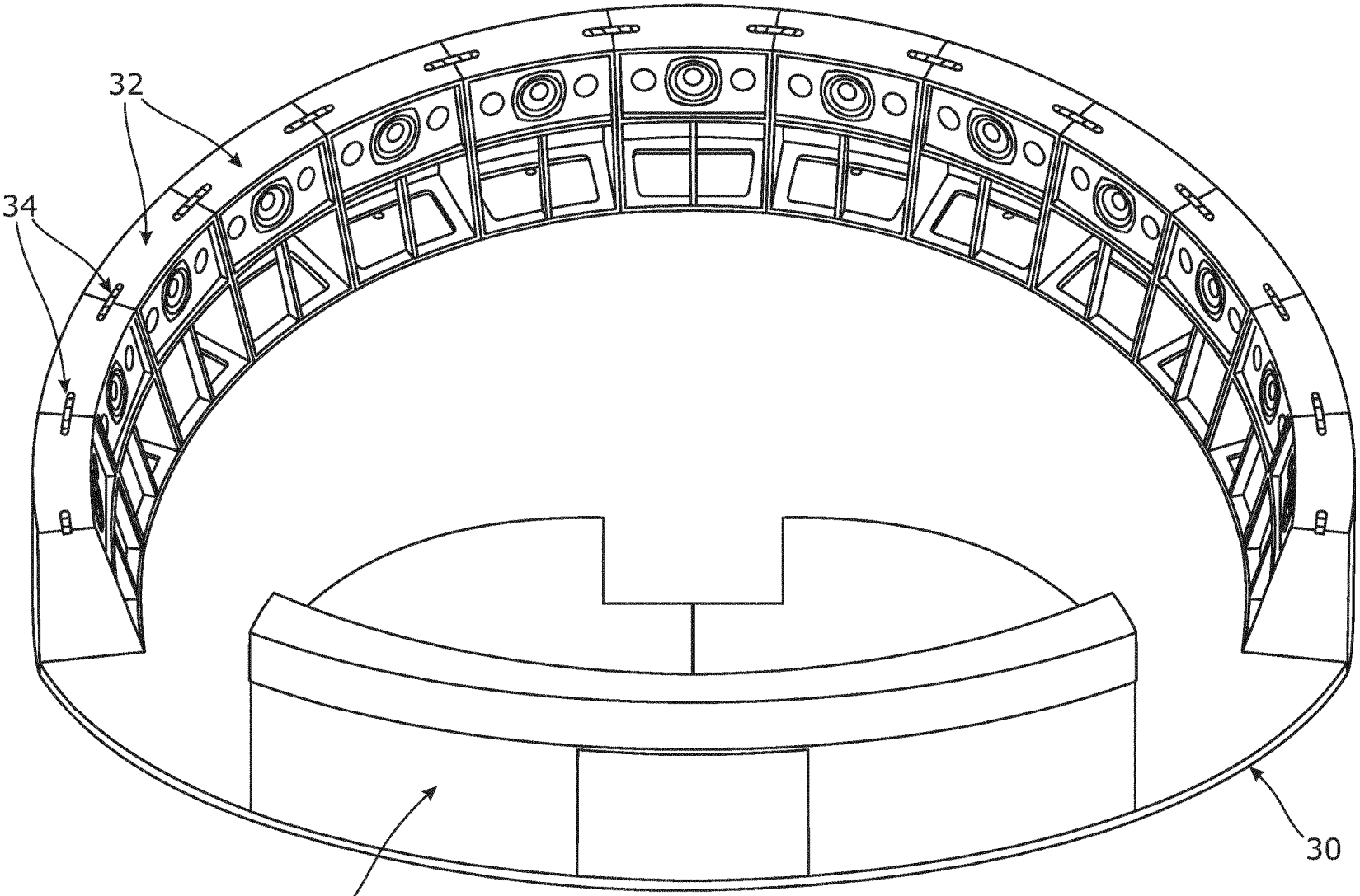
FIG. 2 is a perspective rear view of the apparatus in FIG. 1.
Figure 3:
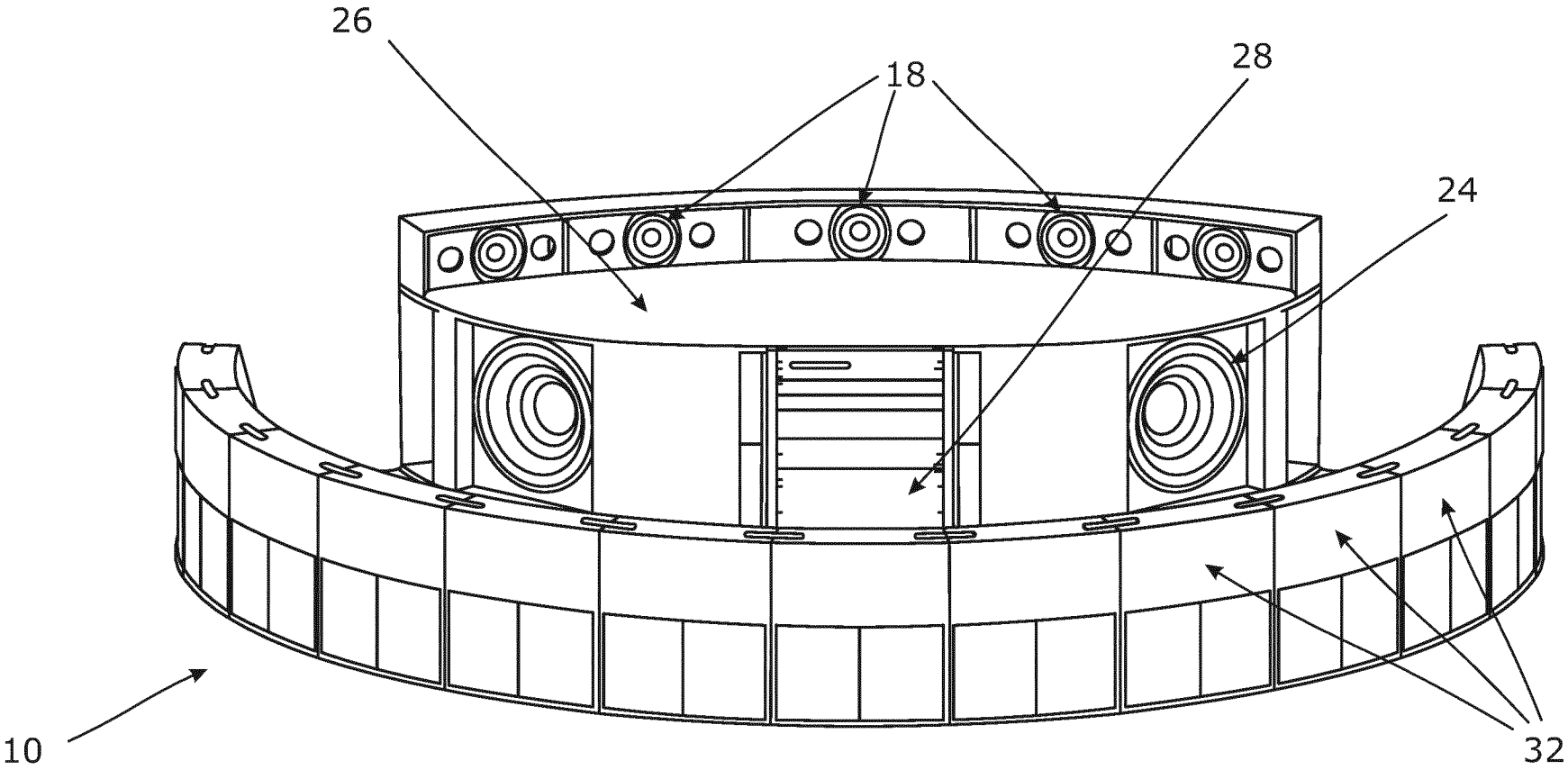
FIG. 3 is a perspective front view of the apparatus in FIG. 1.

FIGS. 1 to 3 show an apparatus 10 for reproducing a multi-channel audio signal according to the embodiment. The apparatus 10 comprises a plurality of first loudspeakers 12 provided spaced around a first arc 14. Each of the first loudspeakers 12 face towards a listening zone 16 provided within the apparatus 10. The first loudspeakers 12 are preferably each substantially equidistant from the listening zone 16. The first arc 14 is preferably circular as shown in the drawings; however, elliptical or other arcuate curves may also be used.

A plurality of second loudspeakers 18 are provided spaced around a second arc 20. Each of the second loudspeakers 18 faces towards the listening zone 16.

A listener 22 is shown in FIG. 1 in the listening zone 16 facing towards the first loudspeakers 12. Throughout the specification, the terms 'forward' and 'behind' are used relative to the listening zone 16 according to the orientation of the listener 22 shown in FIG. 1.

As seen in FIG. 1, the first loudspeakers 12 are positioned forward of the listening zone 16 and surround the forward 180° from the listening zone 16. The second loudspeakers 18 are positioned behind the listening zone 16. In the embodiment, thirteen (13) first loudspeakers 12 and five (5) second loudspeakers 18 are used, though other quantities may be used. It is preferred that at the number of first and second loudspeakers should be at least thirteen, however.

Two low frequency drivers 24 are provided, to either side of and behind the listening zone 16 in an enclosure 26. The low frequency drivers 24 are configured as subwoofers. The second loudspeakers 18 are also provided in the enclosure 26.

The second arc 20 shown in FIG. 1 has a larger radius than the first arc 14. The loudspeakers 18 are positioned closer to the listener 22 than the loudspeakers 12. This reduces the size of the apparatus 10, enabling installation in smaller rooms, without affecting the sound reproduction as experienced by the listener.

An amplifier 28 produces amplified signals from each channel in the audio signal. Preferably, the audio signal has a separate channel for each loudspeaker 12, 18 and 24. Thus, the amplifier 28 provides a separate, amplified signal to each loudspeaker and to the subwoofers. The amplifier 28 is housed behind the listening zone 16 in the enclosure 26. The term amplifier 28 encompasses a multi-channel amplifier, multiple single-channel amplifiers, or a combination of both. Class D amplifiers are preferred for efficiency although other classes may be utilised.

The apparatus 10 has a base 30 on which the enclosure 26 is mounted. Each first loudspeaker 12 is provided in an enclosure 32 mounted to the base 30. Adjacent enclosures 32 are connected via plates 34 extending between their top surfaces. When mounted in this manner, the enclosures 32 form a continuous arc.

The multi-channel audio signal consists of one or more sound objects. Each sound object is present in a plurality of channels of the audio signal as will be described in more detail below.

When the audio signal is reproduced by the apparatus 10, each sound object is reproduced by one or more loudspeakers 12, 18. The sound from each loudspeaker converges on the listening zone 16. Since each loudspeaker 12 is substantially equidistant from the listening zone 16, sounds from adjacent loudspeakers 12 reproducing a sound object arrive at the listening zone 16 at the same time and will add constructively at the listening zone 16.

When the apparatus 10 reproduces the audio signal, the SPL at a point spaced from the apparatus 10 is less than the SPL at the listening zone 16. Two factors contribute to this effect. First, the listening zone 16 is substantially equidistant from the loudspeakers 12 such that their sound outputs combine within the listening zone 16, while at other locations there will be different path lengths from each loudspeaker resulting in some destructive interference. Secondly, the loudspeakers are located near and oriented towards the listening zone 16, while outside the apparatus 10 the average distance to the loudspeakers increases with increasing distance from the apparatus, resulting in a reduced SPL.

Figure 4:
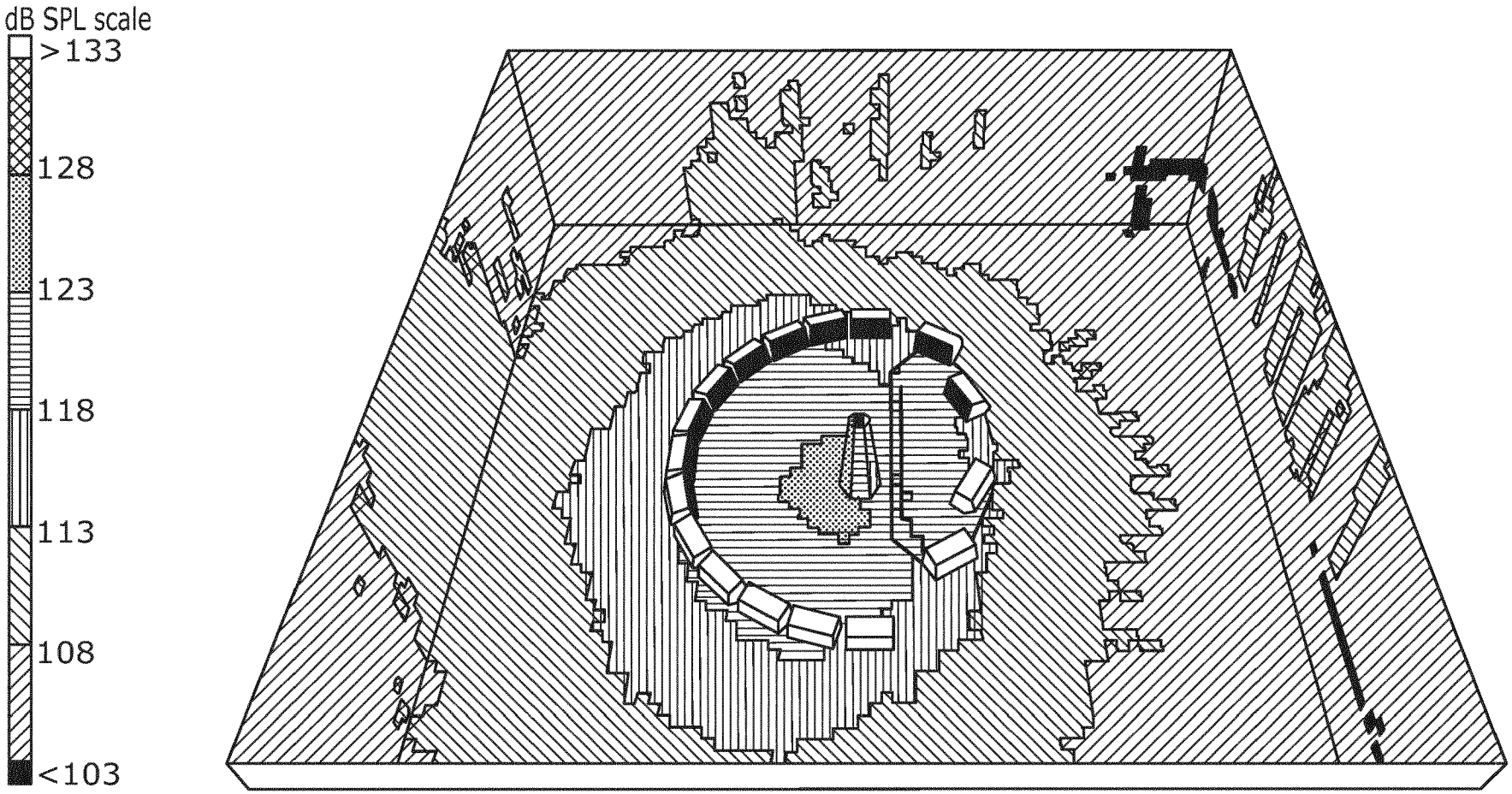
FIG. 4 is shows room sound pressure levels (SPL) when the apparatus of FIG. 1 is in use.
Figure 5:
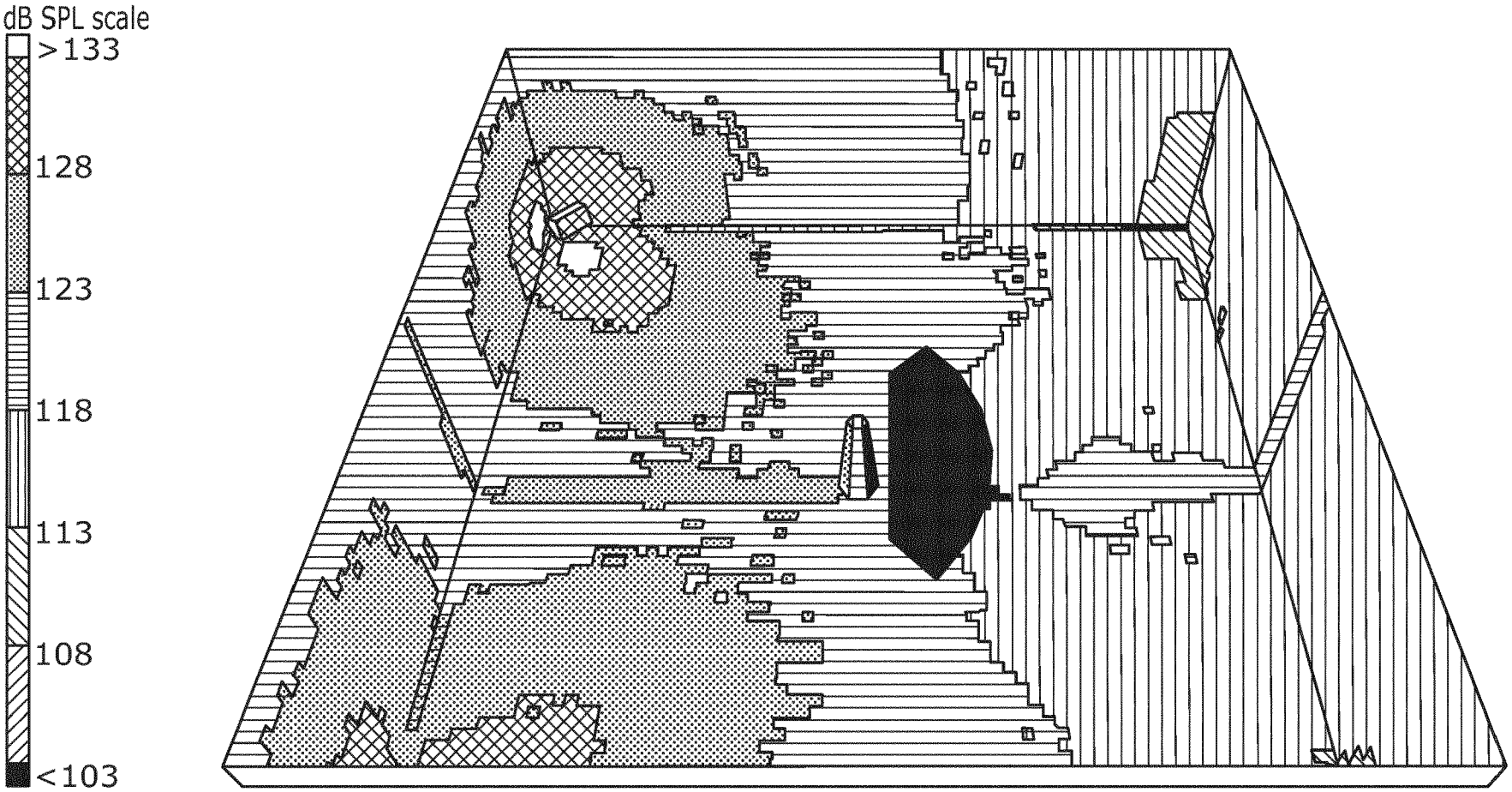
FIG. 5 is shows comparable room SPL using conventional stereophonic loudspeakers and audio system.
Figure 6:
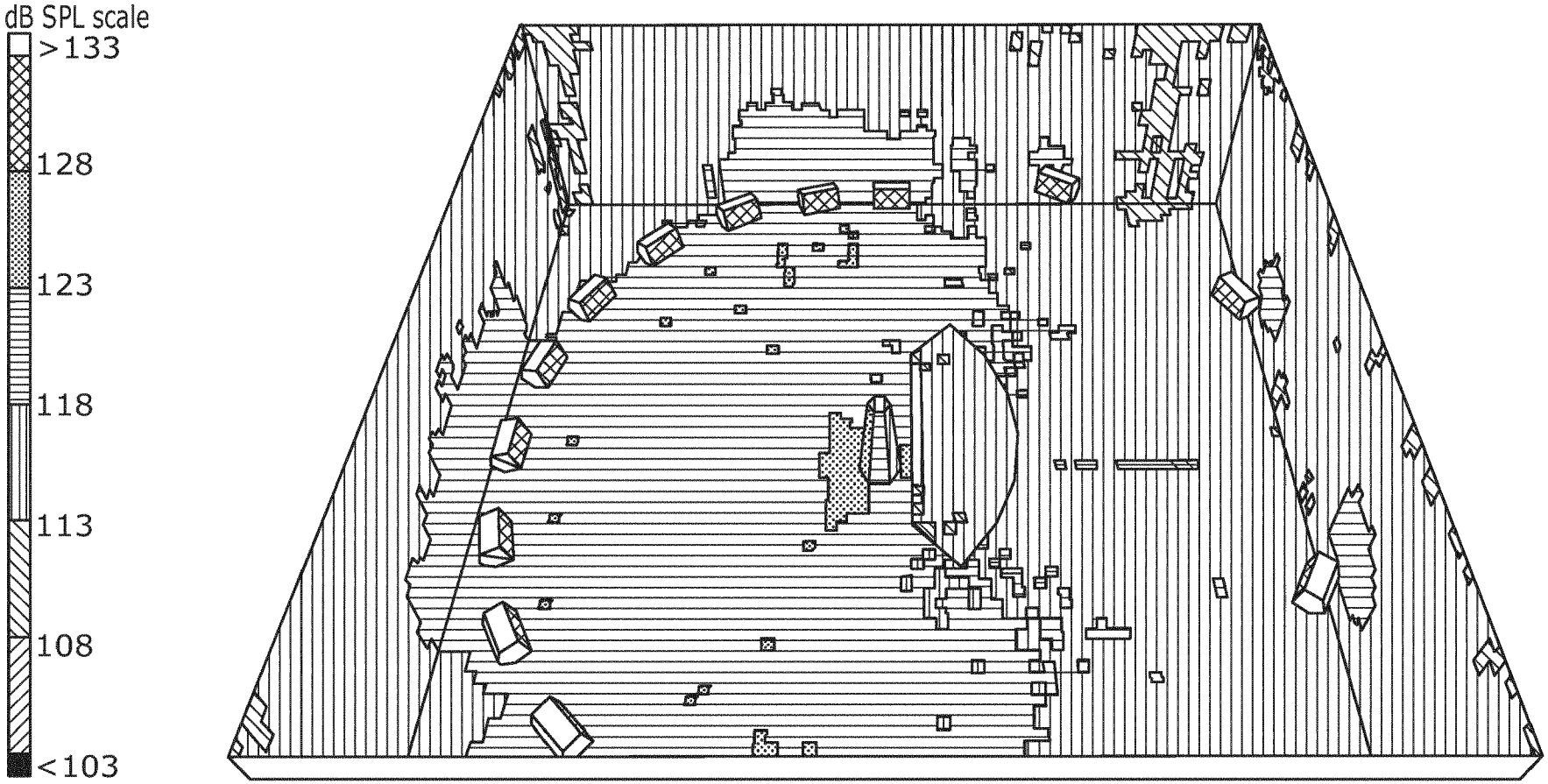
FIG. 6 is shows comparable room SPL using conventional multi-channel loudspeakers and audio system.

FIGS. 4 to 6 show the results of SPL modelling in a 50 $m^2$ room. In each of these figures, the model was set to produce an SPL of 125 dB at the listening zone, and the SPL throughout the room was then calculated.

FIG. 4 shows the SPL using the apparatus 10, in which the SPL at the walls of the room is at least 10 dB and up to 15-20 dB lower than the listening zone. FIG. 5 shows the SPL using a traditional stereophonic arrangement. The SPL is greatest in this arrangement in the immediate vicinity of the loudspeakers and adjacent walls. FIG. 6 shows the SPL in typical multi-channel systems with loudspeakers at the periphery of the room. As shown, the SPL throughout the room and the walls is relatively even.

Production of conventional audio signals involves arranging monaural tracks, with each track representing a sound object; such tracks are also referred to as sound object signals. For a studio recording, there would be a track for each instrument and vocal singer. The sound engineer arranges these tracks, adjusting relative amplitudes. The tracks are then mixed together and reduced to the number of channels using amplitude panning techniques.

The preferred method of producing an audio signal according to the embodiment involves three process stages applied to the track for each sound object—depth, width and pan—described below with reference to FIG. 7.

Depth:

Each track, or sound object signal, is filtered via a low pass second order IIR filter 102, a low shelf second order IIR filter 104 and a high shelf second order IIR filter 106. These filters 102, 104 and 106 are applied in order to represent frequency variations that occur when the distance to a sound source increases. A gain stage 108, provided at the output of the filter 106, produces two depth-corrected output signals, referred to as direct and reverberant signals.

Examples of filters 102, 104 and 106 and gain stage 108 are given below for a depth parameter d having a value between 0 and 1, where 0 is close to the listener and 1 is far away:

Filter 102 may be a Butterworth 2nd order low pass filter with a cut-off frequency fc, where fc=20 kHz if d<=0.2, and fc=20 kHz-15 kHz*(d−0.2)/0.8 if d>0.2.

Filter 104 may be a low Shelf second order IIR filter with a corner frequency of 80 Hz, Q=0.5, and gain (dB)=3.0*$(1.0-5*d)^2$ if d<=0.2, and gain (dB)=−6.0*$((d-0.2)/0.8)^2$ if d>0.2.

Filter 106 may be a high shelf second order IIR filter with a corner frequency of 16 kHz, Q=0.5, and gain (dB)=6.0*$(1.0-5*d)^2$ if d<=0.2, and gain (dB)=0.0 if d>0.2.

Gain stage 108 may be a simple gain control where gain (dB)=3.0*(1.0−5*d)$^2$ if d<=0.2, and gain (dB)=−12.0*((d−0.2)/0.8)$^2$ if d>0.2.

It should be appreciated that the above values are one example only, and other values may be used.

The direct signal is passed to the Width stage described below. The reverberant signal is processed using an acoustic space simulator 110. The simulator 110 adds a configurable amount of reverberation. Balancing the amplitudes of the direct and reverberant signals, for example in the gain stage 108, provides an additional sense of depth. The simulator 110 uses a 1 input, n outputs algorithm. The n outputs have similar energy content, but are de-correlated using feedback delay networks with a different time constants for each output.

The de-correlated nature of the n outputs enables them to be played by adjacent loudspeakers without affecting the listener 22's location of the sound object (which is located by the direct signal), whilst contributing to focussing acoustic energy at the listening zone 16 and providing a sense of depth. Typically, n<13 and the n outputs may be mapped to all channels in the audio signal, with several of them being fed by the same output. Alternatively, the n outputs may be mapped to a subset of these channels using, for example, standard audio panning techniques.

Width:

The direct signal from the depth stage is input to a fourth order crossover filter 112 that splits the signal into two bands: a low frequency (LF) part, and a high frequency (HF) part. The crossover frequency of the filter 112 is chosen so that it is below the spatial aliasing frequency $f_a=2c/d_{speaker}$, where $f_a$ is the spatial aliasing frequency, c is the speed of propagation of sound in air, and $d_{speaker}$ is the distance between the centers of two adjacent speakers. In the embodiment, the $f_a$ is approximately 500 Hz, but nothing prevents use of a lower frequency.

Figure 7:
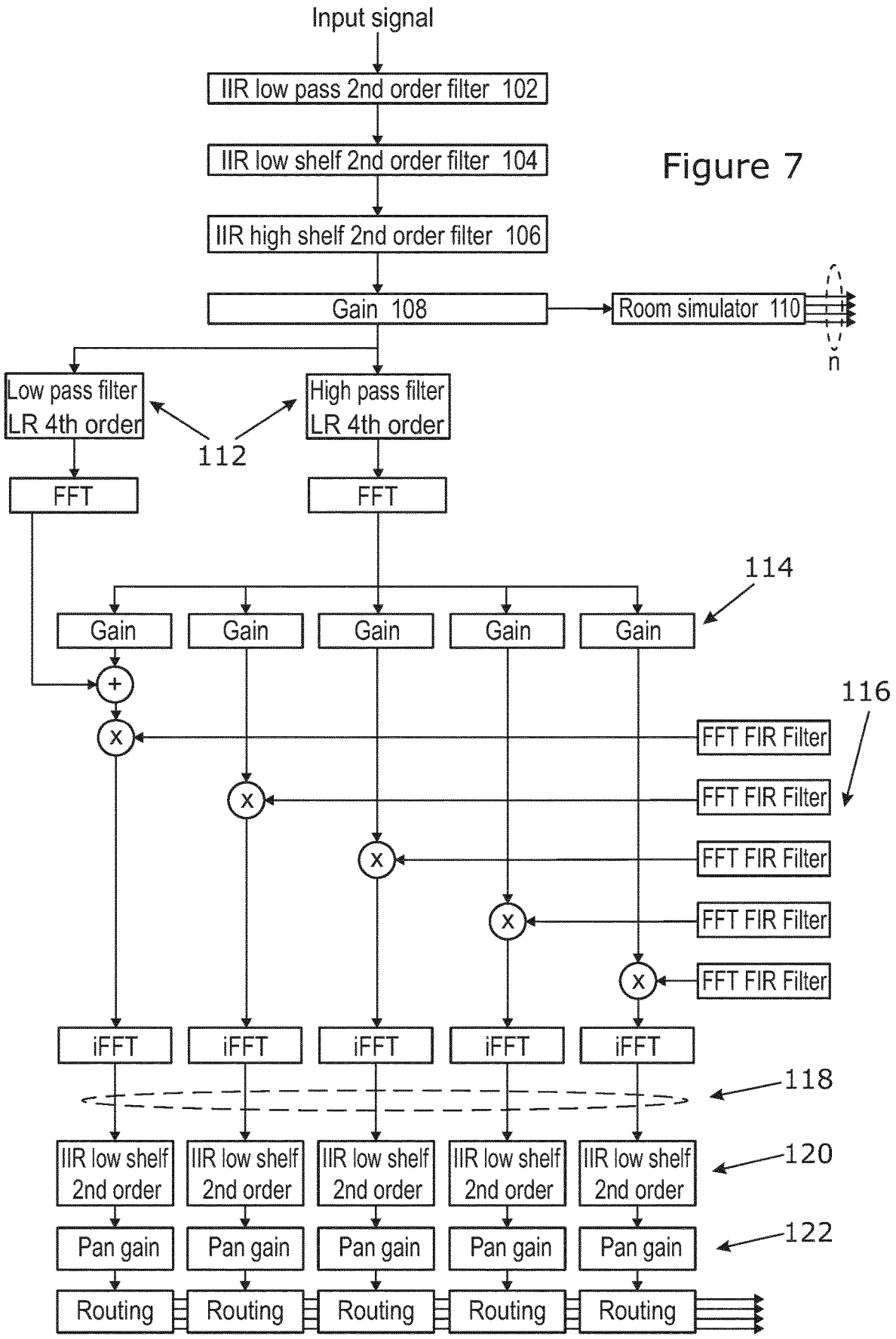
FIG. 7 is a signal processing diagram showing a method for producing a multi-channel audio signal according to one embodiment of the invention.

The HF part of the signal is passed through k parallel gain stages 114, to produce k signals, with FIG. 7 drawn for the instance of k=5. The gain stages 114 apply gains to each of the k signals following a Gaussian distribution, whose standard deviation is controlled by an adjustable Width parameter. It is preferred that the gains of the gain stages 114 are normalised such that the sum of the k gain stage 114 outputs does not show any amplitude deviation from the HF input signal. The greater the value of the Width parameter, the more even the distribution of gains applied by the gain stages 114. This results in more control over the SPL outside the apparatus 10.

It is preferred that k is an odd number, so that the middle of the k signals has a greater amplitude than the other of the k signals, which aids the listener 22 to locate the sound object. In other embodiments, values of k other than 5 may be used.

Each of the k signals passes through one of k all-pass FIR filters 116. Each FIR filter 116 alters the phase of the incoming signal with a spectral period T and a different initial phase offset compared to the other FIR filters 116 to produce one of k width signals, shown in FIG. 7 at 118. The k width signals are de-correlated in phase due to the effect of the filters 116. Phase oscillation patterns such as sinusoids can be used, as well as other phase oscillation patterns.

The effect of the Width processing stage is to produce k width signals with relative phase properties to enable their playback on k adjacent loudspeakers of the apparatus 10, without creating frequency cancellations in the listening zone 16.

FIG. 7 shows the LF part being summed to the middle signal of the k signals. In other embodiments, the LF part could be applied to more than one of the k signals or follow the same gain/pan distribution as the HF part described above.

Pan:

The k width signals are each passed through a second order IIR low shelf filter 120 and gain stage 122 to produce k pan signals. The filter 120 provides a low-frequency gain correction that reduces the change in tonality of a sound object when panned across loudspeakers 12, 18. Typically, the gain of the filter 120 is −3 dB when an object is equidistant to its two closest speakers.

Next, standard amplitude panning techniques are used to map the k pan signals to channels in the audio signal. The k pan signals are panned with an angular step corresponding to the angular distance between loudspeakers 12, 18 depending on the location of the sound object. This results in a set of signals, in k or k+1 of the channels in the audio signal, with similar energy content but de-correlated in phase. This contributes to focussing acoustic energy at the listening zone. The listener's ability to locate the sound object is unaffected: the listener will determine the location of a sound object based on the loudest apparent source of sound; the de-correlated signals to either side of the loudest signal for each sound object to not affect the listener's location of the sound object since de-correlated sound has no apparent location to a listener.

The above processing is performed for each sound object, and the outputs combined for channel to produce the multi-channel audio signal. This processing technique provides a sound stage with superior three-dimensionality, enhanced user ability to locate each sound object with precision, while maintaining a precise control of how the acoustic energy spreads outside the apparatus.

While aspects of the present disclosure have been particularly shown and described with reference to the embodiments above, it will be understood by those skilled in the art that various additional embodiments may be contemplated by the modification of the disclosed apparatuses, systems and methods without departing from the spirit and scope of the invention as defined by the claims.

The invention claimed is:

1. A method for producing a multi-channel audio signal from one or more sound object signals, comprising:

for each sound object signal:

producing a plurality of de-correlated width signals, wherein the amplitudes of said width signals follows a substantially Gaussian distribution, wherein the substantially Gaussian distribution follows a user-configurable standard deviation;

normalizing the amplitudes of the width signals such that an amplitude of the sum of the width signals is equal to the amplitude of the sound object signal;

processing the plurality of width signals to produce a plurality of pan signals, each pan signal being mapped to at least one channel;

for each channel in the audio signal, combining the pan signals from each sound object for that channel.

2. The method of claim 1, wherein each width signal is de-correlated by adding to each width signal a different phase offset, and altering the phase offset of each width signal with a period T.

3. The method of claim 1, wherein the user-configurable standard deviation is configurable for each sound object signal.

4. The method of claim 1, further comprising processing each sound object signal to produce a depth-corrected signal, and producing the plurality of width signals from the depth-corrected signal.

5. The method of claim 4, wherein each sound object signal is processed to produce two depth-corrected signals, a direct signal and a reverberant signal, wherein the plurality of de-correlated width signals are produced from the direct signal, and wherein the reverberant signal is processed to produce a plurality of de-correlated reverberant output signals, each de-correlated reverberant output signal being mapped to at least one channel in the audio signal.

6. The method of claim 1, wherein the step of producing a plurality of de-correlated width signals further comprises processing each sound object signal using a crossover filter to produce a low frequency part and a high frequency part, the plurality of de-correlated width signals being produced from the high frequency part.

7. The method of claim 5, wherein an odd plurality of de-correlated width signals are produced, wherein the low frequency part is applied to a middle signal of the odd plurality of de-correlated width signals.

* * * * *